US010753220B2

(12) United States Patent
Clark et al.

(10) Patent No.: US 10,753,220 B2
(45) Date of Patent: Aug. 25, 2020

(54) GAS TURBINE ENGINE COMPONENT

(71) Applicant: United Technologies Corporation, Farmington, CT (US)

(72) Inventors: Thomas E. Clark, Sanford, ME (US); Daniel J. Whitney, Topsham, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 216 days.

(21) Appl. No.: 16/019,936

(22) Filed: Jun. 27, 2018

(65) Prior Publication Data

US 2020/0003066 A1 Jan. 2, 2020

(51) Int. Cl.

| | |
|---|---|
| ***F01D 11/08*** | (2006.01) |
| ***F01D 25/00*** | (2006.01) |
| *F01D 25/18* | (2006.01) |
| *F01D 25/24* | (2006.01) |

(52) U.S. Cl.

CPC ..... *F01D 11/08* (2013.01); *F01D 25/005* (2013.01); *F01D 25/18* (2013.01); *F01D 25/246* (2013.01); *F05D 2220/323* (2013.01); *F05D 2230/60* (2013.01); *F05D 2240/11* (2013.01); *F05D 2300/6033* (2013.01)

(58) Field of Classification Search

CPC .. F01D 11/08–24; F01D 11/005; F01D 11/12; F01D 25/12; F01D 25/24; F01D 25/246; F01D 9/04; F01D 9/041; F05D 2240/11

See application file for complete search history.

(56) References Cited

U.S. PATENT DOCUMENTS

| | | | | |
|---|---|---|---|---|
| 4,526,226 | A | 7/1985 | Hsia et al. | |
| 4,676,715 | A | 6/1987 | Imbault et al. | |
| 6,048,170 | A | 4/2000 | Dodd | |
| 6,932,566 | B2 | 8/2005 | Suzumura et al. | |
| 9,175,579 | B2 * | 11/2015 | Franks | F01D 25/246 |
| 10,087,784 | B2 * | 10/2018 | Shapiro | F01D 25/246 |
| 10,094,234 | B2 * | 10/2018 | O'Leary | F01D 11/10 |
| 10,378,385 | B2 * | 8/2019 | Tesson | F01D 25/246 |
| 10,378,387 | B2 * | 8/2019 | Baldiga | F01D 25/28 |
| 2004/0219009 | A1 * | 11/2004 | Marchi | F01D 9/04 415/116 |
| 2008/0309019 | A1 * | 12/2008 | Wolfe | F01D 11/003 277/420 |
| 2013/0156556 | A1 | 6/2013 | Franks et al. | |

(Continued)

FOREIGN PATENT DOCUMENTS

| | | |
|---|---|---|
| EP | 1219783 | 7/2002 |
| EP | 3115560 | 1/2017 |
| WO | 2017103411 | 6/2017 |

OTHER PUBLICATIONS

EP Search report for Application No. 19182900.1 dated Dec. 4, 2019.

*Primary Examiner* — Kenneth J Hansen
*Assistant Examiner* — Behnoush Haghighian
(74) *Attorney, Agent, or Firm* — Carlson, Gaskey & Olds, P.C.

(57) ABSTRACT

A blade outer air seal includes a base portion that extends between a leading edge and a trailing edge. A forward wall and an aft wall extend radially outward from the base portion to a radially outer portion. The radially outer portion is spaced from the base portion.

21 Claims, 7 Drawing Sheets

(56) References Cited

U.S. PATENT DOCUMENTS

| | | | | |
|---|---|---|---|---|
| 2014/0023489 | A1* | 1/2014 | Fujimoto | F16J 15/0887 415/170.1 |
| 2014/0023490 | A1 | 1/2014 | Hillier | |
| 2016/0097303 | A1* | 4/2016 | Baldiga | F01D 11/08 416/182 |
| 2016/0376906 | A1* | 12/2016 | O'Leary | F01D 11/10 415/173.1 |
| 2017/0037740 | A1* | 2/2017 | O'Leary | F01D 11/12 |

* cited by examiner

GAS TURBINE ENGINE COMPONENT

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

The efficiency of the engine is impacted by ensuring that the products of combustion pass in as high a percentage as possible across the turbine blades. Leakage around the blades reduces efficiency.

Thus, a blade outer air seal is provided radially outward of the blades to prevent leakage radially outwardly of the blades. The blade outer air seal may be held radially outboard from the rotating blade via connections on the case or a blade outer air seal support structure. The clearance between the blade outer air seal and a radially outer part of the blade is referred to as a tip clearance. Maintaining a proper tip clearance improves the efficiency of the gas turbine engine by reducing the amount of air leaking past the blade tips.

SUMMARY

In one exemplary embodiment, a blade outer air seal includes a base portion that extends between a leading edge and a trailing edge. A forward wall and an aft wall extend radially outward from the base portion to a radially outer portion. The radially outer portion is spaced from the base portion.

In a further embodiment of any of the above, the radially outer portion is spaced inward from circumferential edges of the base portion.

In a further embodiment of any of the above, a radially outer edge of the forward wall is spaced a first distance from the base portion. A radially outer edge of the aft wall is spaced a second distance from the base portion. The second distance is greater than the first distance.

In a further embodiment of any of the above, the blade outer air seal is made entirely from a composite matrix composite.

In a further embodiment of any of the above, the radially outer portion is centered between circumferential edges of the base portion.

In a further embodiment of any of the above, the radially outer portion is closer to a first circumferential edge of the base portion than a second circumferential edge.

In a further embodiment of any of the above, the forward wall is spaced a first distance from the leading edge and the after wall is spaced a second distance from the trailing edge and the first distance is greater than the second distance.

In another exemplary embodiment, a seal assembly includes at least one blade outer air seal that includes a base portion that extends between a leading edge and a trailing edge. A forward wall and an aft wall extend radially outward from the base portion to a radially outer portion. The radially outer portion is spaced from the base portion. At least one wear liner located adjacent the radially outer portion.

In a further embodiment of any of the above, the at least one wear liner includes a planer central portion and a pair of radially outward extending arms.

In a further embodiment of any of the above, troughs connect the planer central portion to a corresponding one of the pair of radially outward extending arms.

In a further embodiment of any of the above, at least one attachment body is located between the forward wall and the aft wall.

In a further embodiment of any of the above, the attachment body includes at least one end portion located within a passage at least partially defined by the forward wall, the aft wall, the radially outer portion, and the base portion.

In a further embodiment of any of the above, the wear liner spaces the attachment body from the radially outer portion.

In a further embodiment of any of the above, troughs connect the planer central portion to a corresponding one of the pair of radially outward extending arms. The troughs contact at least one attachment body.

In a further embodiment of any of the above, each of the pair of radially outward extending arms includes a circumferentially extending tab.

In a further embodiment of any of the above, the attachment body includes at least one forward hook and at least one aft hook.

In another exemplary embodiment, a method of assembling a blade outer air seal assembly includes the steps of inserting a wear liner within a passage through a first blade outer air seal. The blade outer air seal is engaged with at least two radially extending arms on the wear liner. An attachment body is inserted within the passage.

In a further embodiment of any of the above, the attachment body engages the wear liner and is spaced from the blade outer air seal.

In a further embodiment of any of the above, each of the at least two radially extending arms includes a circumferentially extending tab that engages the wear liner.

In a further embodiment of any of the above, the method includes anti-rotating the attachment body relative to the first blade outer air seal with at least one forward tab and at least one aft tab on the attachment body.

DETAILED DESCRIPTION

Figure 1:
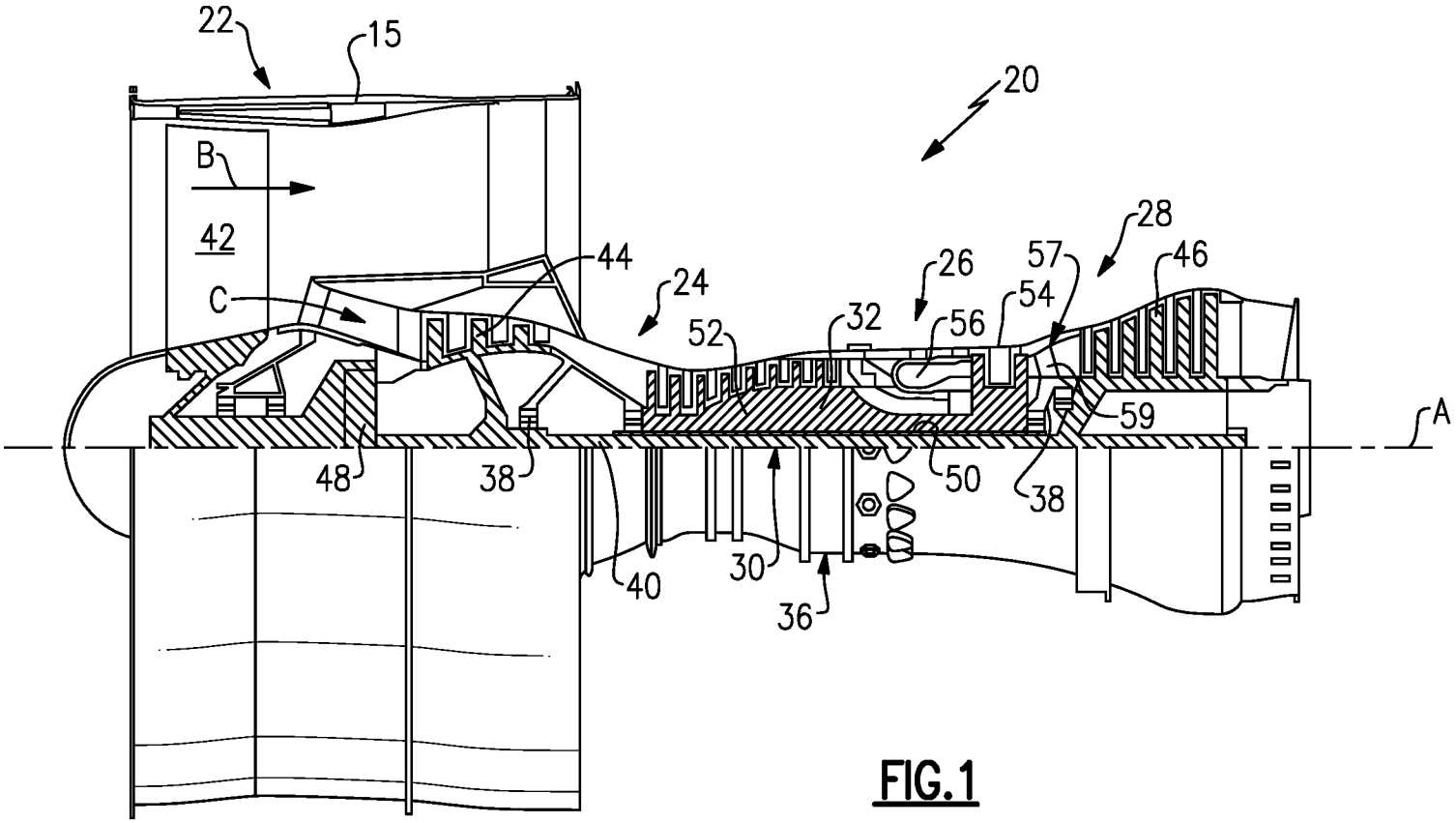
FIG. 1 is a schematic view of an example gas turbine engine according to a non-limiting example.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC)"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
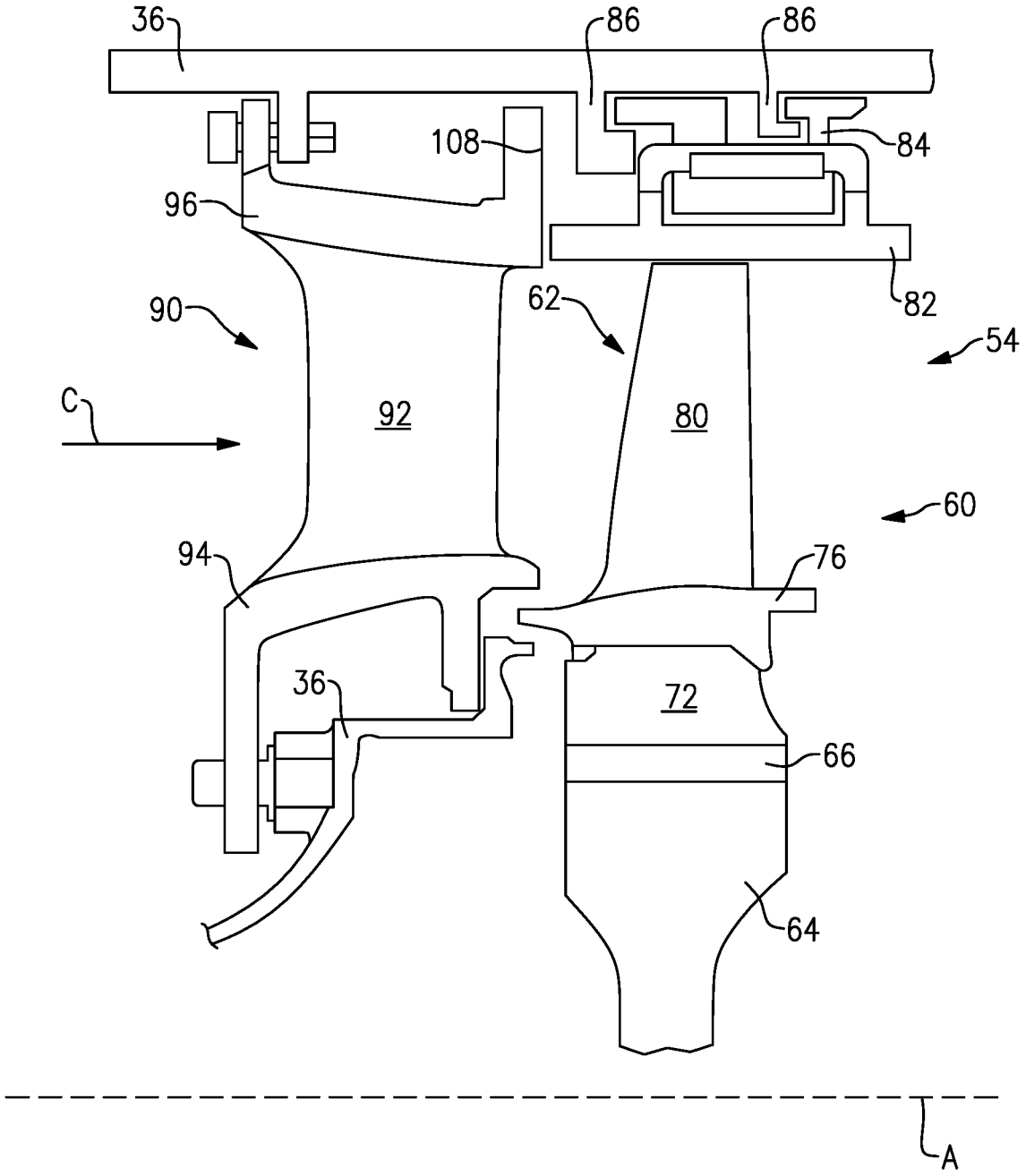
FIG. 2 is an enlarged schematic view of a portion of a turbine section.

FIG. 2 illustrates an enlarged schematic view of the high pressure turbine 54, however, other sections of the gas turbine engine 20 could benefit from this disclosure, such as the compressor section 24 or low pressure turbine 46. In the illustrated example, the high pressure turbine 54 includes a one-stage turbine section including a first rotor assembly 60. In another example, the high pressure turbine 54 could include a two-stage high pressure turbine section with multiple rotor assemblies.

The first rotor assembly 60 includes a plurality of first rotor blades 62 circumferentially spaced around a first disk 64 to form an array. Each of the plurality of first rotor blades 62 include a first root portion 72, a first platform 76, and a first airfoil 80. Each of the first root portions 72 is received within a respective first rim 66 of the first disk 64. The first airfoil 80 extends radially outward toward a blade outer air seal (BOAS) 82. The BOAS 82 is attached to the engine static structure 36 by an attachment body 84 engaging retention hooks 86 on the engine static structure 36. In the illustrated example, the attachment body 84 is a separate structure from the BOAS 82.

The plurality of first rotor blades 62 are disposed in the core flow path C that is pressurized in the compressor section 24 then heated to a working temperature in the combustor section 26. The first platform 76 separates a gas path side inclusive of the first airfoils 80 and a non-gas path side inclusive of the first root portion 72.

A plurality of vanes 90 are located axially upstream of the plurality of first rotor blades 62. Each of the plurality of vanes 90 includes at least one airfoil 92 that extends between a respective vane inner platform 94 and a vane outer platform 96. In another example, each of the array of vanes 90 include at least two airfoils 92 forming a vane double.

Figure 3:
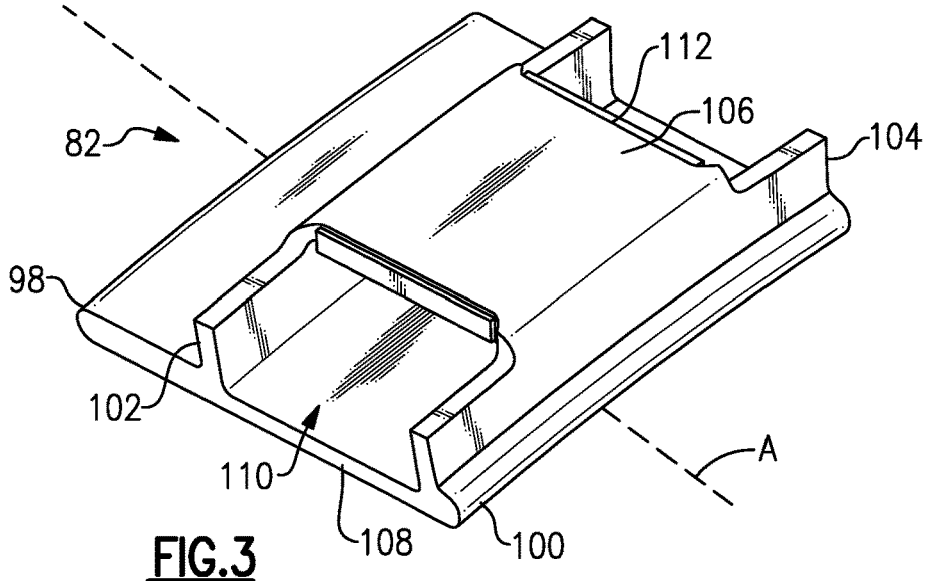
FIG. 3 is perspective view of a blade outer air seal and wear liner.
Figure 4:
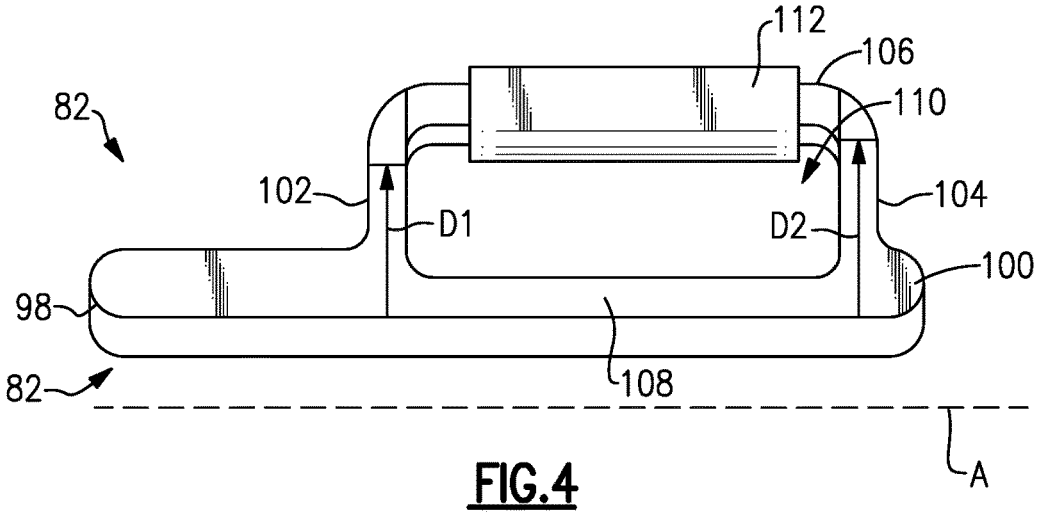
FIG. 4 is a side view of the blade outer air seal and wear liner.

As shown in FIGS. 3 and 4, the blade outer air seal 82 includes a leading edge 98 and a trailing edge 100. In the illustrated example, the BOAS 82 is made of a ceramic matrix composite (CMC) and includes a forward wall 102 and an aft wall 104 that extend radially outward from a base portion 108 to an outer wall 106. The BOAS 82 may also be made of a monolithic ceramic. The base portion 108 extends between the leading edge 98 and the trailing edge 100. The outer wall 106 includes a generally constant thickness and constant position in the radial direction such that an outer surface of the outer wall 106 is planer. In this disclosure, forward, aft, upstream, downstream, axial, radial, or circumferential is in relation to the engine axis A unless stated otherwise.

In the illustrated example, circumferentially outward of the outer wall 106, the forward wall 102 extends a distance D1 from a radially inner edge of the BOAS 82 and the aft wall 104 extends a distance D2 from the radially inner edge of the BOAS 82 with the distance D2 being greater than the distance D1. By having the distance D1 being less than the distance D2, the BOAS 82 can be assembled into a ring (see FIG. 9B) with multiple blade outer air seals 82 and have a greater amount of clearance along a leading region for assembly into the gas turbine engine 20. Assembly time of the gas turbine engine can be reduced when the ring of blade outer air seals 82 does not need to be installed individually but as a continuous ring with multiple segments (See FIG. 9B).

The forward wall 102, the aft wall 104, the outer wall 106, and the base portion 108 of the BOAS 82 define a passage 110 for accepting a wear liner 112, such as a metallic wear liner. A radially inner side of the base portion 108 at least partially defines the core flow path C and is located adjacent a tip of the airfoil 80 (See FIG. 2).

Figure 5:
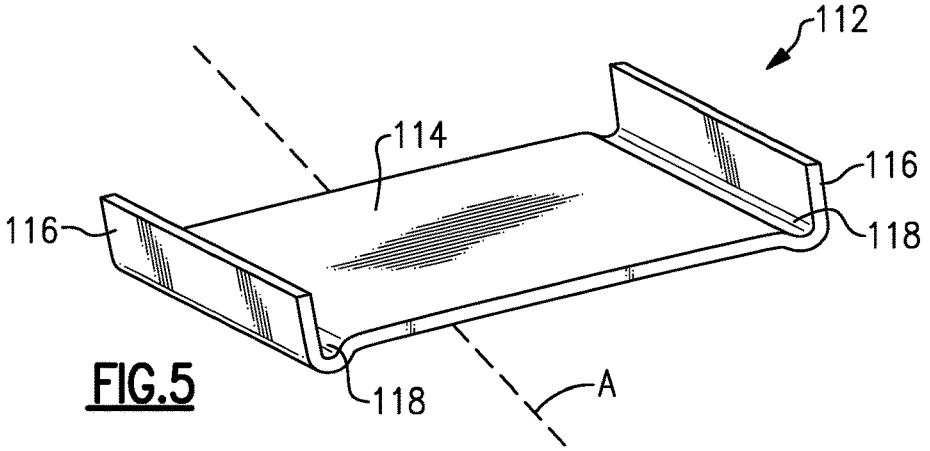
FIG. 5 is a perspective view of the wear liner.

As shown in FIGS. 3-5, a wear liner 112 surrounds a radially inner side as well as circumferential ends of the outer wall 106. The wear liner 112 includes a planer central portion 114 and a pair of radially outward extending arms 116. A trough 118 connects the planer central portion 114 to a corresponding one of the pair of radially outward extending arms 116. The troughs 118 extend in the axial direction as well as radially inward from the planer central portion 114 to define a radially outward opening U-shape. The radially outward extending arms 116 are spaced apart from each other a distance sufficient to accept the outer wall 106. In one example, the radially outward extending arms 116 engage opposing circumferential ends of the outer wall 106 to secure the wear liner 112 to the BOAS 82.

Figure 6:
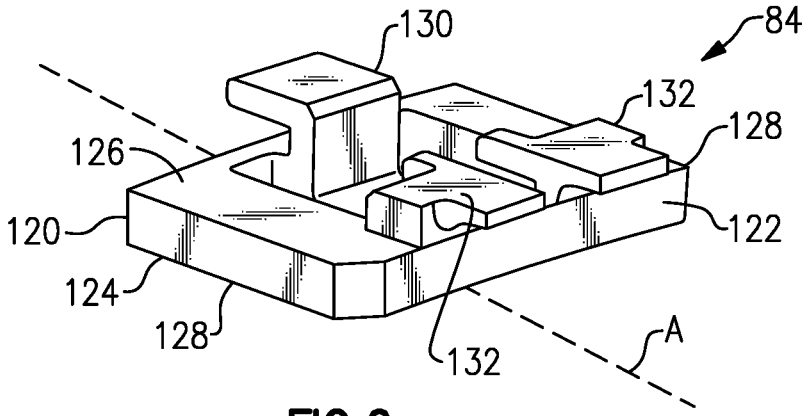
FIG. 6 is a perspective view of an attachment body.

FIG. 6 illustrates the attachment body 84. The attachment body 84 includes a leading edge 120 and a trailing edge 122 connected by a radially inner surface 124 and a radially outer surface 126. The radially inner surface 124 and the radially outer surface 126 also extend between opposing circumferential sides 128 on circumferential end portions of the attachment body 84. A forward hook 130 extends from the radially outer surface 126 of the attachment body 84. The forward hook 130 includes a radially outward extending portion and an axially forward extending portion. At least one aft hook 132 also extends from the radially outer surface 126 and includes a portion extending radially outward and a portion extending axially forward and aft of the portion extending radially outward. In the illustrated example, the axially forward extending portions on the forward hook 130 and the aft hook 132 engage the retention hooks 86 on the engine static structure 36 (See FIG. 2).

Figure 7:
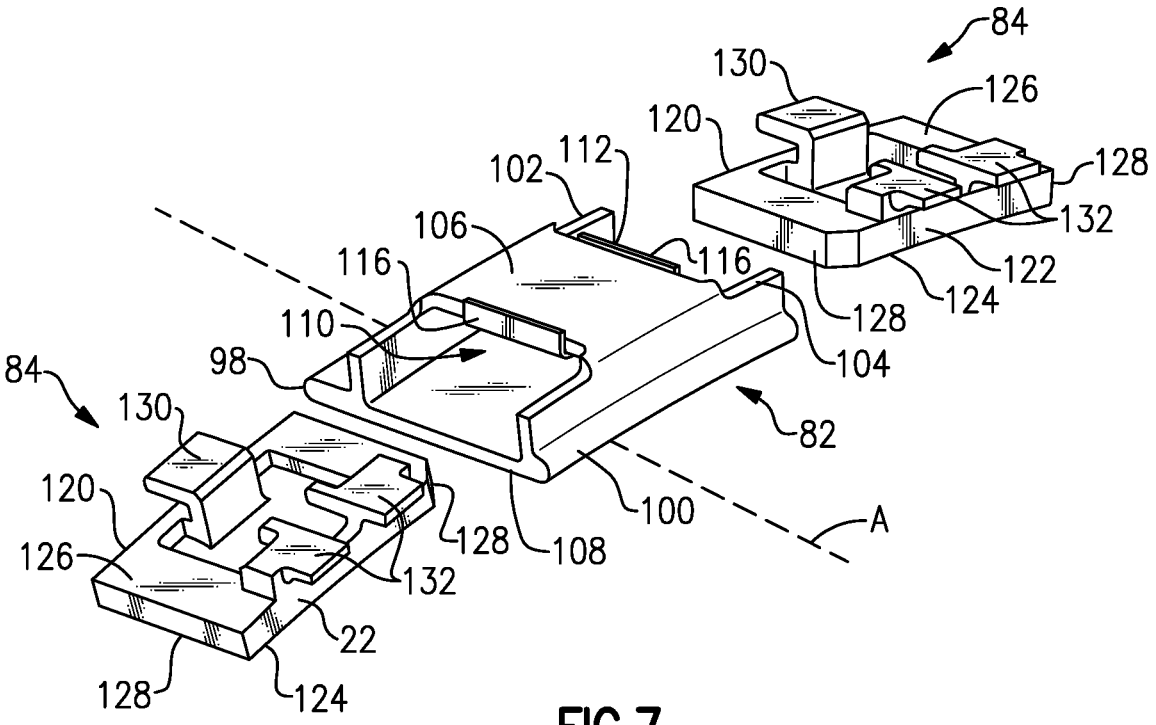
FIG. 7 is a partially assembled view of the blade outer air seal and wear liner of FIG. 3 with a pair of attachment bodies of FIG. 6.

FIGS. 7-9B illustrate an assembly procedure for the BOAS 82, attachment body 84, and wear liner 112. As shown in FIG. 7, the wear liner 112 is initially installed on the BOAS 82 by moving the wear liner 112 circumferentially through the passage 110 until the wear liner 112 is aligned circumferentially with the outer wall 106 of the BOAS 82. Once the wear liner 112 is aligned circumferentially with the outer wall 106, the wear liner 112 is moved radially outward until the pair of radially outward extending arms 116 surround the outer wall 106 on the BOAS 82.

Figure 8:
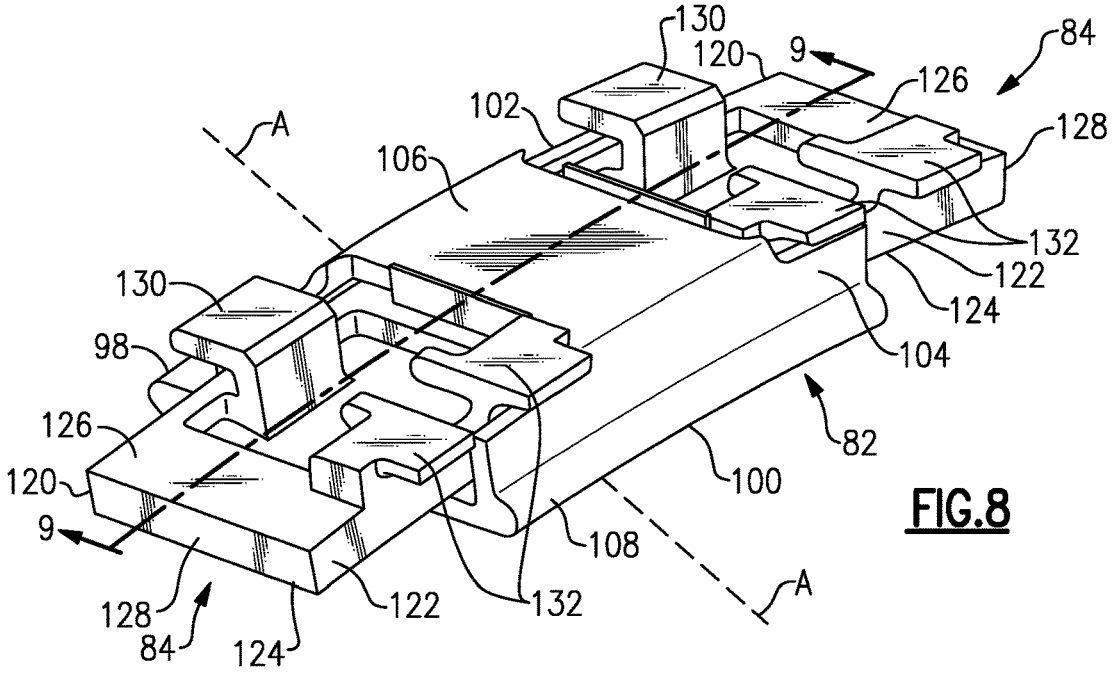
FIG. 8 is a perspective view of the blade outer air seal and wear liner of FIG. 3 assembled with the pair of attachment bodies of FIG. 6.
Figure 9A:
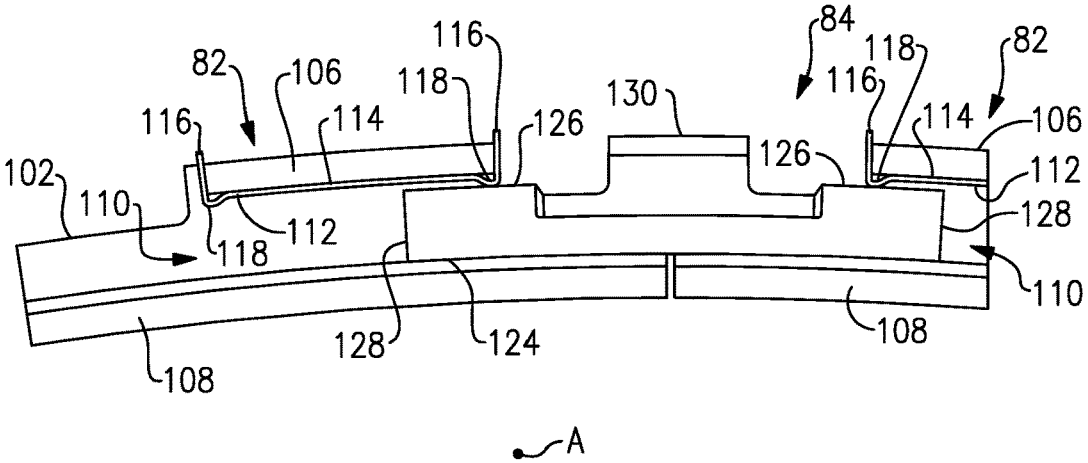
FIG. 9A is a cross-sectional view along line 9-9 of FIG. 8.
Figure 9B:
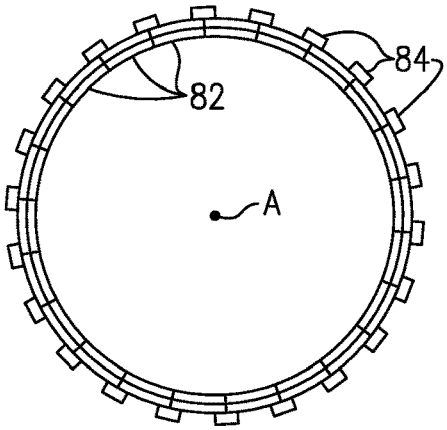
FIG. 9B schematically illustrates multiple blade outer air seals from FIG. 3 arranged into a segmented ring.

At least one attachment body 84 is then radially aligned with the passage 110 in the BOAS 82 and then moved circumferentially into the passage 110 such that one of the circumferential sides 128 of the attachment body 84 is accepted within the passage 110 (See FIGS. 8 and 9A). This procedure is continued until a plurality of BOAS 82 form a complete ring as shown in FIG. 9B.

As shown in the cross-sectional view in FIG. 9A, the wear liner 112 separates the attachment body 84 from the BOAS 82 and in particular the outer wall 106 of the BOAS 82 and the attachment body 84. The troughs 118 separates the planer central portion 114 of the wear liner 112 from the attachment body 84 such that the attachment body 84 primarily contacts the troughs 118 on the wear liner 112. By separating the attachment body 84 from the BOAS 82, the attachment body 84 could be made from a higher density material that could wear away the BOAS 82 if directly contacted. In one example, the attachment body 84 is made from a nickel based alloy and the wear liner 112 is made from a cobalt based alloy.

Figure 10:
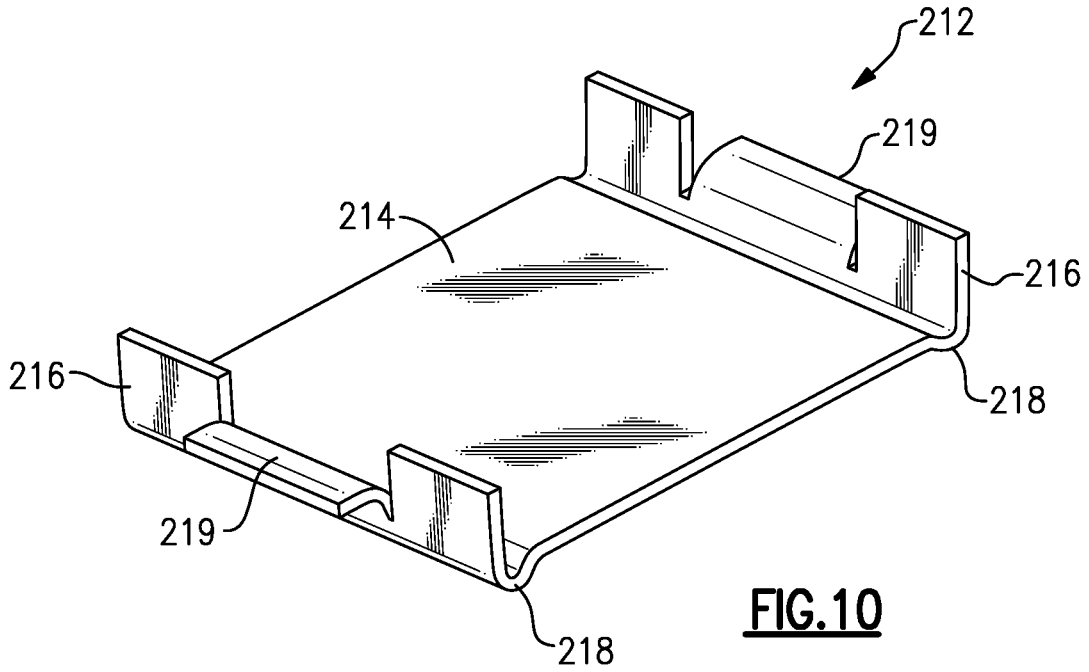
FIG. 10 is a perspective view of another example wear liner.
Figure 11:
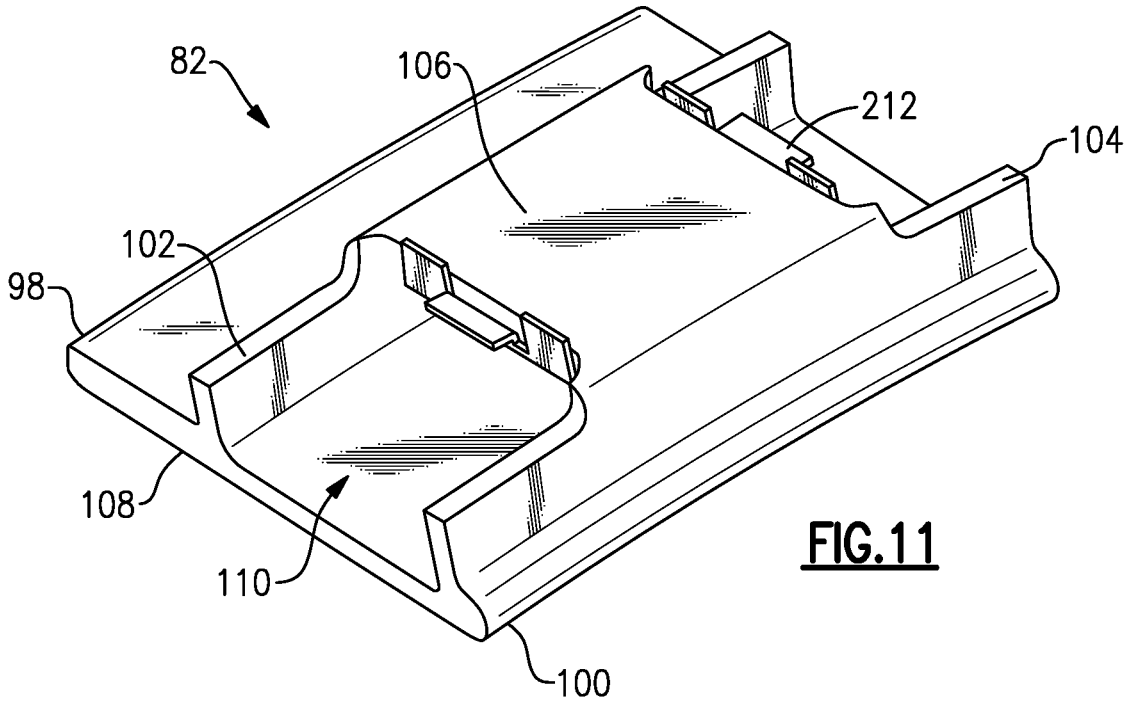
FIG. 11 is a perspective view of the blade outer air seal of FIG. 3 with the wear liner of FIG. 10.

FIGS. 10 and 11 illustrate another example wear liner 212 used in connection with the BOAS 82 described above. The wear liner 212 is similar to the wear liner 112 except where described below or shown in the Figures. As shown in FIG. 10, the wear liner 212 includes a planer central portion 214 and a pair of radially outward extending arms 216. Each of the pair of radially outward extending arms 216 include one outwardly extending tab 219. In this example, outward includes a component extending in a circumferential direction. As will be discussed further below, the outwardly extending tabs 219 serve an anti-rotation function in connection with attachment bodies 284 (see FIG. 12).

A trough 218 connects the planer central portion 214 to a corresponding one of the pair of radially outward extending arms 216. The troughs 218 extend in the axial direction as well as radially inward from the planer central portion 214. The outward extending arms 216 are spaced apart from each other a distance sufficient to accept the outer wall 106 on the BOAS 82. In one example, the radially outward extending arms 216 engage opposing circumferential ends of the outer wall 106 to secure the wear liner 212 to the BOAS 82.

Figure 12:
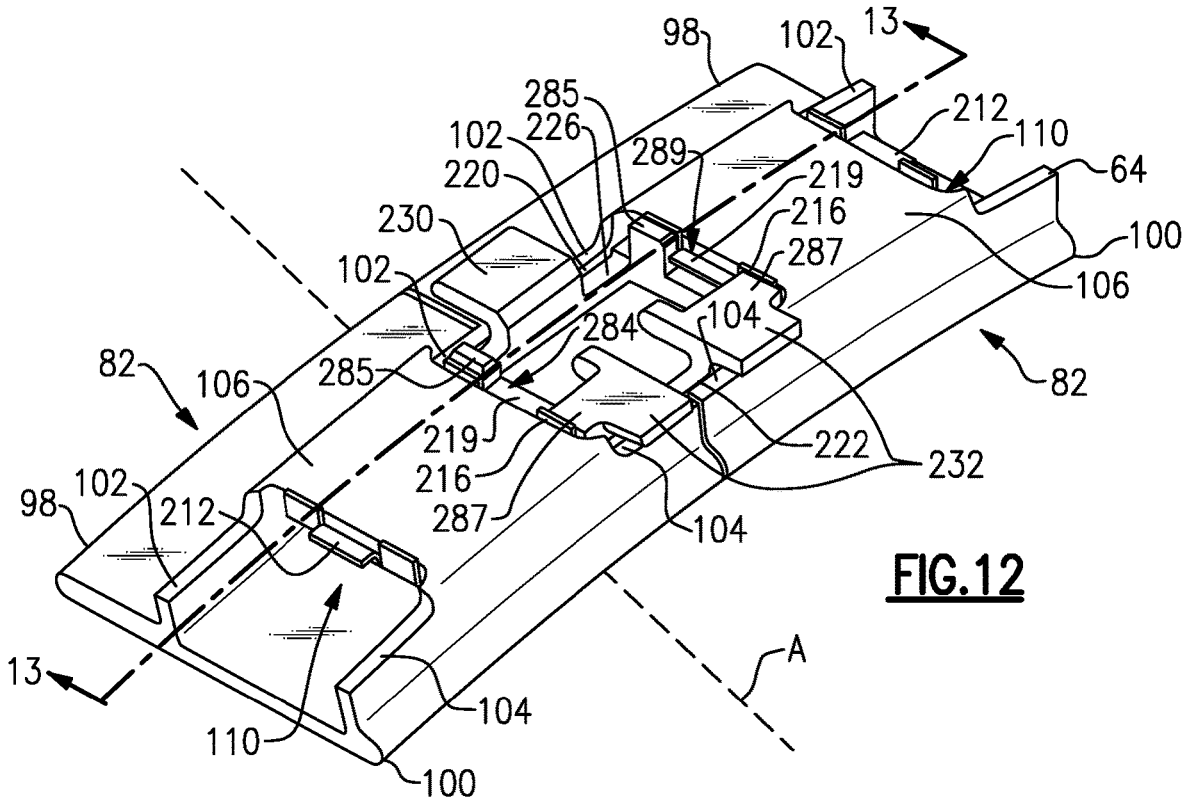
FIG. 12 illustrates another example attachment body assembled with a pair of blade outer air seals and wear lines of FIG. 11.
Figure 13:
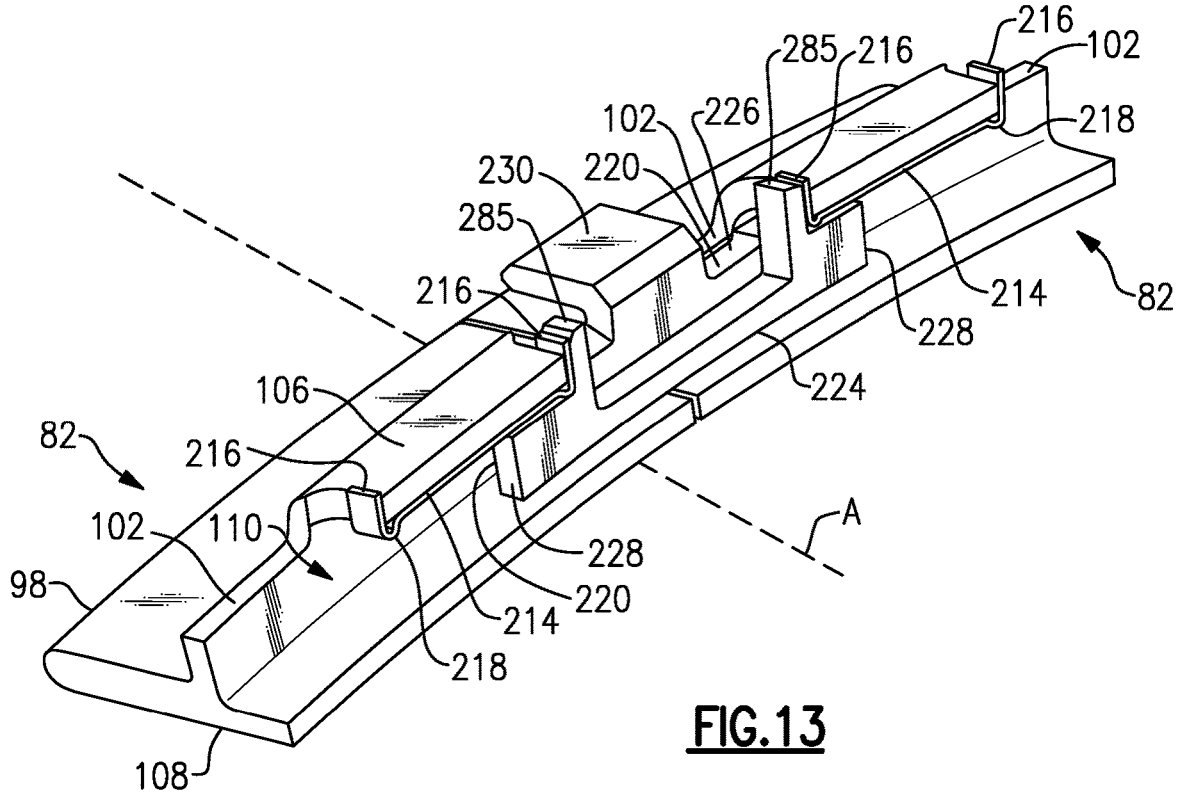
FIG. 13 is a cross-sectional view along line 13-13 of FIG. 12.

As shown in FIGS. 12 and 13, the attachment body 284 includes a leading edge 220 and a trailing edge 222 connected by a radially inner surface 224 and a radially outer surface 226. The radially inner surface 224 and the radially outer surface 226 also extend between opposing circumferential sides 228 on circumferential end portions of the attachment body 284. A forward hook 230 extends from the radially outer surface 226 of the attachment body 284. The forward hook 230 includes a radially outward extending portion and an axially forward extending portion. At least one aft hook 232 also extends from the radially outer surface 226 and includes a portion extending radially outward and a portion extending axially forward and aft of the portion extending radially outward. In the illustrated example, the axially forward extending portions on the forward hook 230 and the aft hook 232 engage the retention hooks 86 on the engine static structure 36 (See FIG. 2).

As shown in FIG. 12, when the BOAS 82 is assembled with the wear liner 212 and the attachment body 284, the tabs 219 engage a portion of the attachment body 284. In particular, the attachment body 284 includes a pair of forward tabs 285 and a pair of aft tabs 287 that form a recess 289 for accepting a corresponding one of the tabs 219. The forward tabs 285 and the aft tabs 287 extend radially outward from the radially outer surface 226 of the attachment body 284. Because the tabs 219 are accepted within one of the corresponding recesses 289 in the attachment body 284 to prevent the wear liner 212 from moving relative to the attachment body 284 and riding on one of the forward wall 102 or aft wall 104 of the BOAS 82. Moreover, the aft tabs 287 may be integrated into a portion of the aft hooks 232 as shown in the illustrated example or be spaced from the aft hooks 232.

The wear liner 212, the attachment body 284, and the BOAS 82 are assembly in a similar manner as described above with respect to the wear liner 112, attachment body 84, and BOAS 82 except where shown in the Figures or described below. After the wear liner 212 is placed on the BOAS 82 in a manner as described above, the attachment body 284 is radially aligned with the passage 110 on the BOAS 82 and moved circumferentially into the passage 110. As the attachment body 284 moves into the passage 110, a corresponding one of the tabs 219 on the wear liner 212 is accepted within the recess 289 formed by a corresponding pair of the forward tabs 285 and aft tabs 287. An axially forward edge of the tab 219 will engage an axially aft surface on the forward tab 285 and an axially aft edge of the tab 219 will engage an axially forward surface on the aft tab 287. This engagement will prevent the wear liner 212 from moving relative to the attachment body 284.

As shown in FIGS. 12 and 13, the pair of forward tabs 285 and the pair of aft tabs 287 are spaced inward from circumferential sides 228 of the attachment body 284. This allows the attachment body 284 to extend further into the passage 110 on the BOAS 82 to reduce relative movement between the components. Furthermore, circumferentially outer surfaces of the radially outward extending arms 216 engage corresponding circumferentially outer surfaces on the forward pair of tabs 285 and the pair of aft tabs 287. This increases the number of contact points between the attachment body 284 and the wear liner 212, which reduces the amount of movement relative to the attachment body and the wear liner 212. The BOAS 82, the wear liners 212, and the attachment bodies 284 are also assembled into a complete ring in a similar manner as schematically illustrated in FIG. 9B.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A blade outer air seal comprising:

a base portion extending between a leading edge and a trailing edge;

a forward wall and an aft wall extending radially outward from the base portion to a radially outer portion, wherein the radially outer portion is spaced from the base portion and includes opposing circumferential edges defining wear liner contact surfaces, the forward wall is space a first distance from the leading edge and the aft wall is spaced a second distance from the trailing edge and the first distance is greater than the second distance, and a forward direction and an aft direction are in relation to a direction of airflow from the leading edge to the trailing edge; and a passage extending between circumferential edges of the base portion at least partially defined by the forward wall, the aft wall, and the base protion.

2. The blade outer air seal of claim 1, wherein the radially outer portion is spaced inward from circumferential edges of the base portion and the first wall and the aft wall extend circumferentially in opposing directions past the radially outer portion.

3. The blade outer air seal of claim 2, wherein a radially outer edge of the forward wall is spaced a first distance from the base portion and a radially outer edge of the aft wall is spaced a second distance from the base portion and the second distance is greater than the first distance.

4. The blade outer air seal of claim 1, wherein the blade outer air seal is made entirely from a ceramic matrix composite.

5. The blade outer air seal of claim 1, wherein the radially outer portion is centered between circumferential edges of the base portion.

6. The blade outer air seal of claim 1, wherein the radially outer portion is closer to a first circumferential edge of the base portion than a second circumferential edge.

7. The blade outer air seal of claim 1, wherein the radially outer portion is spaced inward from circumferential edges of the base portion and the forward wall and the aft wall extend past the radially outer portion to circumferentially opposing edges of the base portion.

8. A seal assembly comprising:

at least one blade outer air seal including:

a base portion extending between a leading edge and a trailing edge; and a forward wall and an aft wall extending radially outward from the base portion to a radially outer portion, wherein the radially outer portion is spaced from the base portion, the forward wall is spaced a first distance from the leading edge and the aft wall is space a second distance from the trailing edge and the first distance is greater than the second distance, and forward and aft are in a relation to a direction of airflow from the leading edge to the trailing edge; and at least one wear liner engaging opposing circumferential edges of the radially outer portion.

9. The seal assembly of claim 8, wherein the blade outer air seal includes a passage at least partially defined by the base portion, the forward wall, the aft wall, and the radially outer portion and the least one wear liner includes a planer central portion and a pair of radially outward extending arms that engage the opposing circumferential edges of the radially outer portion.

10. The seal assembly of claim 9, wherein troughs connect the planer central portion to a corresponding one of the pair of radially outward extending arms.

11. The seal assembly of claim 10, further comprising at least one attachment body located between the forward wall and the aft wall and the attachment body extends through only a portion of the passage.

12. The seal assembly of claim 11, wherein the attachment body includes at least one end portion located within a passage at least partially defined by the forward wall, the aft wall, the radially outer portion, and the base portion.

13. The seal assembly of claim 12, wherein the wear liner spaces the attachment body from the radially outer portion.

14. The seal assembly of claim 13, wherein the troughs contact the at least one attachment body.

15. The seal assembly of claim 9, wherein each of the pair of radially outward extending arms includes a circumferentially extending tab.

16. The seal assembly of claim 11, wherein the attachment body includes at least one forward hook and at least one aft hook.

17. The seal assembly of claim 8, wherein the radially outer portion is spaced inward from circumferential edges of the base portion and the forward wall and the aft wall extend past the radially outer portion to circumferentially opposing edges of the base portion.

18. A method of assembling a blade outer air seal assembly comprising the steps of:

inserting a wear liner within a passage through a first blade outer air seal, wherein the passage is at least partially defined by a base portion, a forward wall and aft wall extending radially outer from the base portion, and a radially outer portion spaced from the base portion and connected to the forward wall and the aft wall;

engaging opposing circumferential edges of the radially outer portion on the blade outer air seal with a corresponding one of at least two radially extending arms on the wear liner; and inserting an attachment body within the passage.

19. The method of claim 18, wherein the attachment body engages the wear liner and is spaced from the blade outer air seal, the attachment body includes a forward hook and a pair of aft hooks, and the attachment body extends through only a portion of the passage.

20. The method of claim 19, wherein each of the at least two radially extending arms includes a circumferentially extending tab that engages the blade outer air seal.

21. The method of claim 18, further comprising anti-rotating the attachment body relative to the first blade outer air seal with at least one forward tab and at least one aft tab on the attachment body and forward and aft are in relation to a direction of airflow over the blade outer air seal in a gas turbine engine.

* * * * *